US010001757B2

(12) United States Patent
Akiyama

(10) Patent No.: US 10,001,757 B2
(45) **Date of Patent: *Jun. 19, 2018**

(54) ELECTRONIC TIMEPIECE AND METHOD FOR CONTROLLING DISPLAY OPERATION OF ELECTRONIC TIMEPIECE

(71) Applicant: Seiko Epson Corporation, Tokyo (JP)

(72) Inventor: Toshikazu Akiyama, Matsumoto (JP)

(73) Assignee: Seiko Epson Corporation (JP)

( * ) Notice: Subject to any disclaimer, the term of this patent is extended or adjusted under 35 U.S.C. 154(b) by 89 days.

This patent is subject to a terminal disclaimer.

(21) Appl. No.: 15/087,359

(22) Filed: Mar. 31, 2016

(65) Prior Publication Data

US 2016/0216697 A1 Jul. 28, 2016

Related U.S. Application Data

(63) Continuation of application No. 14/476,119, filed on Sep. 3, 2014, now Pat. No. 9,335,743.

(30) Foreign Application Priority Data

Sep. 10, 2013 (JP) ..... 2013-187151

(51) Int. Cl.
*G04R 20/06* (2013.01)
*G04R 20/04* (2013.01)
(Continued)

(52) U.S. Cl.
CPC ..... *G04R 20/04* (2013.01); *G04B 19/04* (2013.01); *G04G 19/00* (2013.01); *G04R 20/06* (2013.01)

(58) Field of Classification Search
CPC . G04G 9/00; G04G 5/00; G04G 19/00; G04R 20/04; G04R 20/06; G04R 20/02; G04B 19/04
See application file for complete search history.

(56) References Cited

U.S. PATENT DOCUMENTS 5,923,618 A * 7/1999 Nelson, Jr. ..... G01S 19/23 368/155
7,447,931 B1 * 11/2008 Rischar ..... H04J 3/0697 368/46
(Continued)

FOREIGN PATENT DOCUMENTS

JP 2007-271538 A 10/2007
JP 2009-236560 A 10/2009
(Continued)

*Primary Examiner* — Sean Kayes
(74) *Attorney, Agent, or Firm* — Harness, Dickey & Pierce, P.L.C.

(57) ABSTRACT

An electronic timepiece includes a display section, a display control section, a reception section, a clock section, a timing section, a leap second acquisition section, a time correction section that corrects internal time information by using time information acquired by the timing section, and a leap second correction section that corrects the internal time information by using leap second information acquired by the leap second acquisition section. In a case where the operation of the timing section is followed by the operation of the leap second acquisition section, the time correction section corrects the internal time information by using the time information acquired by the timing section, and the display control section causes the display section to display, before the leap second acquisition section acquires the leap second information, time based on the internal time information corrected by the time correction section.

13 Claims, 11 Drawing Sheets

(51) Int. Cl.
*G04B 19/04* (2006.01)
*G04G 19/00* (2006.01)

(56) References Cited

U.S. PATENT DOCUMENTS

| | | | | |
|---|---|---|---|---|
| 9,448,539 | B2 * | 9/2016 | Akiyama ..... | G04R 20/02 |
| 2007/0241959 | A1 | 10/2007 | Nakagawa | |
| 2008/0165628 | A1 | 7/2008 | Urano | |
| 2009/0129206 | A1 | 5/2009 | Baba | |
| 2012/0188854 | A1 | 7/2012 | Baba | |
| 2012/0201101 | A1 | 8/2012 | Akiyama et al. | |
| 2012/0243383 | A1 | 9/2012 | Honda | |
| 2013/0003506 | A1 | 1/2013 | Kato et al. | |
| 2013/0051188 | A1 | 2/2013 | Akiyama et al. | |
| 2014/0241131 | A1 | 8/2014 | Honda | |

FOREIGN PATENT DOCUMENTS

| | | | |
|---|---|---|---|
| JP | 2009-250801 | A | 10/2009 |
| JP | 2011-033381 | A | 2/2011 |
| JP | 2011-208947 | A | 10/2011 |
| JP | 2011-220843 | A | 11/2011 |
| JP | 2012-026774 | A | 2/2012 |
| JP | 2012-150061 | A | 8/2012 |
| JP | 2012-167931 | A | 9/2012 |
| JP | 2012-198100 | A | 10/2012 |
| JP | 2012-202875 | A | 10/2012 |
| JP | 2013-238617 | A | 11/2013 |

* cited by examiner

ELECTRONIC TIMEPIECE AND METHOD FOR CONTROLLING DISPLAY OPERATION OF ELECTRONIC TIMEPIECE

CROSS-REFERENCE TO RELATED APPLICATIONS

This application is a continuation of, and claims priority under 35 U.S.C. § 120 on, U.S. application Ser. No. 14/476,119, filed Sep. 3, 2014, which claims priority under 35 U.S.C. § 119 on Japanese application no. 2013-187151, filed Sep. 10, 2013. Each such related application is incorporated by reference herein in its entirety.

BACKGROUND

1. Technical Field

The present invention relates to an electronic timepiece that receives a satellite signal transmitted from a positional information satellite and corrects displayed time based on the signal and relates also to a method for controlling display operation of the electronic timepiece.

2. Related Art

To receive a satellite signal transmitted from a GPS (global positioning system) satellite and perform time correction based on the signal, it is necessary to acquire leap second information and reflect it in the time correction (see JP-A-2012-150061, for example).

The electronic timepiece described in JP-A-2012-150061 carries out a time correction process in which internal time is corrected by using received time information and when the internal time correction is not based on leap second information, leap second information is received and the internal time is corrected by using the received leap second information. The time displayed on the timepiece is then updated based on the corrected internal time.

Since the leap second information is transmitted at intervals of 12.5 minutes, the time correction process described in JP-A-2012-150061 requires a standby period of 12.5 minutes at longest to receive leap second information. A long period therefore elapses from the initiation of the time correction process to corrected time display operation, which means that a user undesirably cannot check corrected time during the period.

SUMMARY

An advantage of some aspects of the invention is to provide an electronic timepiece that allows a user to quickly check corrected time and a method for controlling display operation of the electronic timepiece.

An aspect of the invention relates to an electronic timepiece including a display section, a display control section that controls the display section, a reception section that receives a satellite signal containing time information and leap second information, a clock section that clocks internal time information, a timing section that controls the reception section to acquire the time information, a leap second acquisition section that controls the reception section to acquire the leap second information, a time correction section that corrects the internal time information by using the time information acquired by the timing section, and a leap second correction section that corrects the internal time information by using the leap second information acquired by the leap second acquisition section, and in a case where the operation of the timing section is followed by the operation of the leap second acquisition section, the time correction section corrects the internal time information by using the time information acquired by the timing section, and the display control section causes the display section to display, before the leap second acquisition section acquires the leap second information, time based on the internal time information corrected by the time correction section.

According to the aspect of the invention, the timing section acquires the time information, and the time correction section corrects the internal time information by using the time information. The leap second acquisition section then controls the reception section in accordance with leap second information reception timing to acquire the leap second information.

In this process, the display control section causes the display section to display, before the leap second acquisition section acquires the leap second information, time based on the internal time information corrected by using the time information.

As a result, since the display section displays the time corrected by using the received time information, the user can quickly check the corrected time without waiting for the leap second information reception timing.

In the electronic timepiece according to the aspect of the invention, it is preferable that, in a case where a leap second reception condition is satisfied, the leap second acquisition section operates after the timing section operates.

The case where a leap second reception condition is satisfied is, for example, either a case where the electronic timepiece stores no leap second information or a case where the current time falls within a semiannual leap second reception period (June 1 to 30 and December 1 to 31, for example) and no leap second information reception has been successful within the period.

In the electronic timepiece according to the aspect of the invention, it is preferable that, in a case where the operation of the timing section is followed by the operation of the leap second acquisition section, the display control section causes the display section to display, before the leap second acquisition section acquires the leap second information, leap second standby information representing that the timepiece is on standby to receive the leap second information.

The user can therefore be informed that leap second information reception starts soon. For example, the user can move the electronic timepiece to an environment where a satellite signal is received in a satisfactory manner or keep the electronic timepiece stationary to improve a successful leap second information reception rate.

In the electronic timepiece according to the aspect of the invention, it is preferable that, in a case where the operation of the timing section is followed by the operation of the leap second acquisition section, the display control section causes the display section to display, before the leap second acquisition section acquires the leap second information, a result of the time information acquisition performed by the timing section.

According to the aspect of the invention described above, the user can check the time information acquisition result, whereby the user can determine whether the received time information is reflected in the time displayed by the display section.

In the electronic timepiece according to the aspect of the invention, it is preferable that, when the display control section receives a reception result display instruction, the display control section causes the display section to display no reception result of the leap second information but display a result of the time information reception performed by the timing section.

According to the aspect of the invention described above, the user can determine by checking the reception result whether or not the time displayed by the display section is a result of successful time information reception.

Although no leap second information reception result is displayed, the leap second information is typically updated once a few years. Therefore, successful acquisition of leap second information once during the period of a few years with unsuccessful leap second information reception at other attempts allows correct displayed time in many cases as long as time information is successfully received. However, displaying a result of unsuccessful leap second information reception as a reception result may mislead the user into believing that correct displayed time resulting from the successful time information reception is incorrect.

In contrast, according to the aspect of the invention described above, as long as the time information reception is successful, a reception result representing successful reception is displayed even when leap second information reception that follows the time information reception is unsuccessful. As a result, no displayed reception result representing unsuccessful reception will mislead the user into believing that the correct displayed time is incorrect.

The reception result display instruction described above may be configured to be outputted, for example, when an operation section provided in the electronic timepiece is operated. In this case, the user can operate the operation section when the user desires to check a reception result to readily check the reception result.

In the electronic timepiece according to the aspect of the invention, it is preferable that the leap second standby information is a remaining period before timing of reception of the leap second information that is detectable when the timing section acquires the time information.

According to the aspect of the invention described above, the user can correctly find the leap second information reception timing and can move the electronic timepiece without fail to an environment where a satellite signal can be received in a satisfactory manner at the leap second information reception timing.

In the electronic timepiece according to the aspect of the invention, it is preferable that the display section has a second hand, a minute hand, an hour hand, and a dial, and that in a case where the operation of the timing section is followed by the operation of the leap second acquisition section, the display control section uses the minute hand and the hour hand to display time based on the internal time information corrected by the time correction section and uses the second hand to display the leap second standby information.

According to the aspect of the invention described above, in an analog display timepiece having a second hand, a minute hand, and an hour hand, the display section can display both the corrected time and the leap second standby information at the same time with no new display mechanism added to the display section.

As a result, the corrected time and the leap second standby information can be so displayed that they are readily visible to the user with the cost of the electronic timepiece lowered.

Another aspect of the invention relates to a method for controlling display operation of an electronic timepiece including a display section, a reception section that receives a satellite signal containing time information and leap second information, and a clock section that clocks internal time information, the method including a timing step of controlling the reception section to acquire the time information, a leap second acquisition step of controlling the reception section to acquire the leap second information, a time correction step of correcting the internal time information by using the time information acquired in the timing step, a leap second correction step of correcting the internal time information by using the leap second information acquired in the leap second acquisition step, and a display step of causing the display section to display information, and in a case where the timing step is followed by the leap second acquisition step, the time correction step corrects the internal time information by using the time information acquired in the timing step, and the display step causes the display section to display, before the leap second information is acquired in the leap second acquisition step, time based on the internal time information corrected in the time correction step.

This aspect of the invention can also provide the same advantageous effects as provided by the electronic timepiece described above. That is, since the display device displays the time corrected by using the received time information, the user can quickly check the corrected time without waiting for the leap second information reception timing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Specific embodiments of the invention will be described below with reference to the drawings.

First Embodiment

Figure 1:
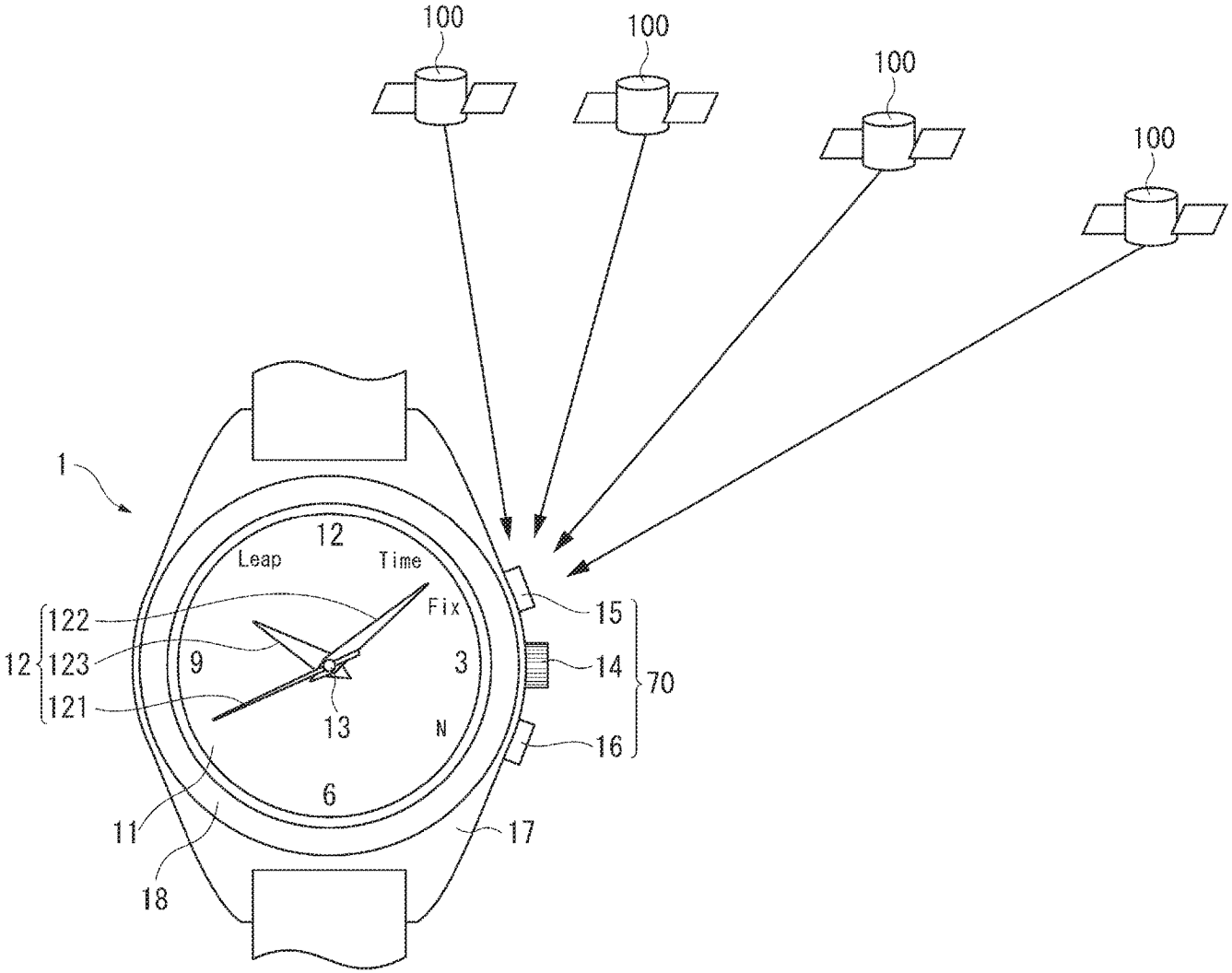
FIG. 1 is a front view showing an electronic timepiece according to an embodiment of the invention.
Figure 2:
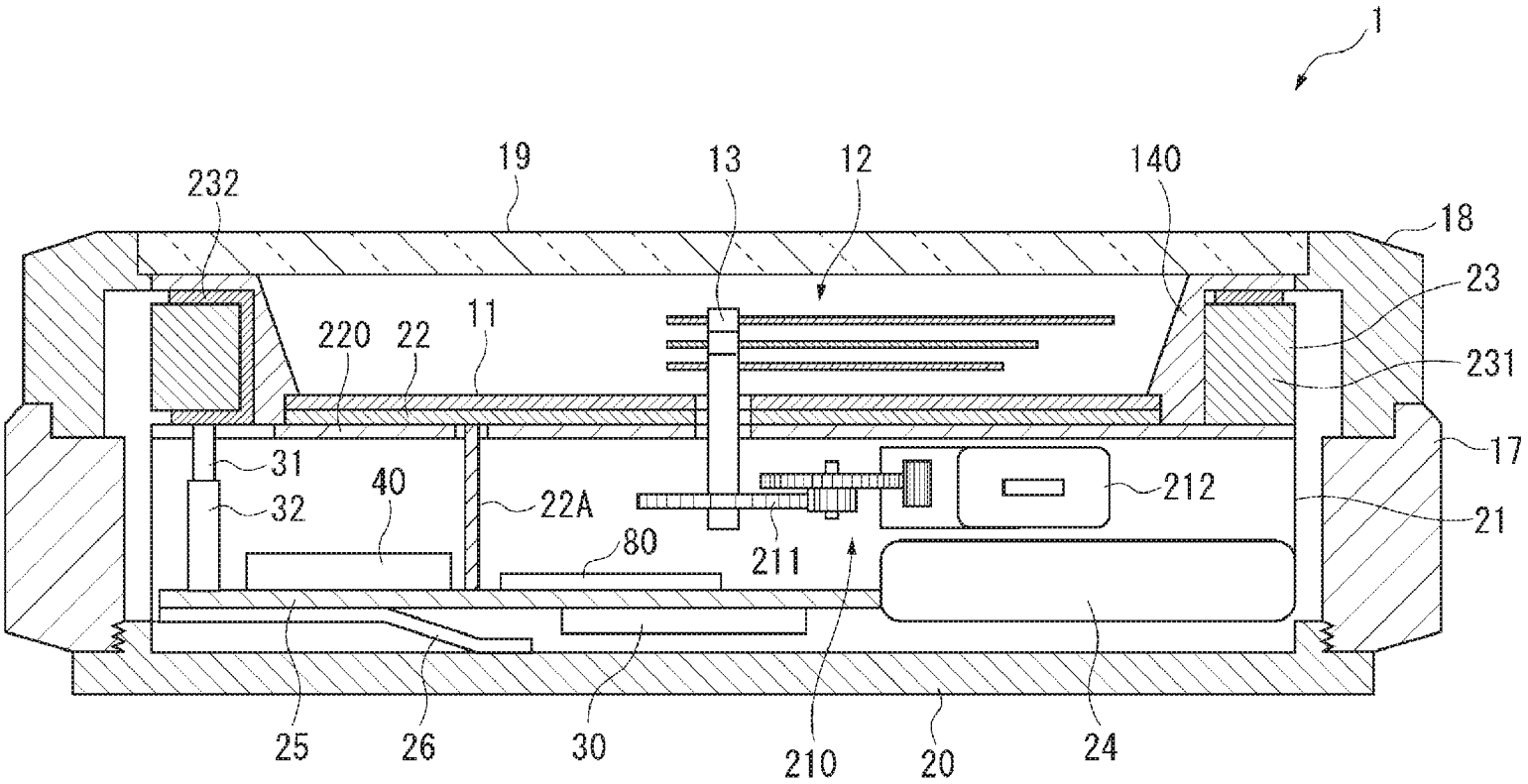
FIG. 2 is a schematic cross-sectional view of the electronic timepiece.

FIG. 1 is a front view of an electronic timepiece 1 according to a first embodiment of the invention, and FIG. 2 is a schematic cross-sectional view of the electronic timepiece 1.

A plurality of GPS satellites 100 go along a predetermined orbit around the earth up in the sky, and the electronic timepiece 1 receives a satellite signal from at least one of the GPS satellites 100 to acquire time information and receives satellite signals from at least three of the GPS satellites 100 to calculate positional information, as shown in FIG. 1. Each of the GPS satellites 100 is an example of a positional information satellite, and there are a plurality of GPS satellites around the earth up in the sky. At present, approximately 30 GPS satellites 100 go around the earth.

Electronic Timepiece

The electronic timepiece 1 is a wristwatch worn around a user' wrist, includes a dial 11 and indication hands 12, and clocks time and displays the clocked time.

A large part of the dial 11 is made of a nonmetal material (plastic or glass material, for example) that readily transmits light and microwaves in a 1.5-GHz band.

The indication hands 12 are provided on the front side of the dial 11. The indication hands 12 include a second hand 121, a minute hand 122, and an hour hand 123, which rotate around a rotary shaft 13 and are driven with a stepper motor via gears.

Operation Performed on Operation Section

The electronic timepiece 1 carries out a process according to manual operation performed on an input device (operation section) 70 having a crown 14 and buttons 15 and 16. Specifically, when the crown 14 is operated, a manual correction process in which displayed time is corrected in accordance with the operation is carried out. When the button 15 is pressed for a long period (period longer than or equal to 3 seconds, for example), a manual reception process in which a satellite signal is received (forced reception process) is carried out.

When the button 16 is pressed, a switching process in which a reception mode (timing mode, positioning mode) is switched from one to the other is carried out.

The timing mode is a mode in which at least one of the GPS satellites 100 is captured followed by satellite signal reception and time information is acquired from the received satellite signal.

The positioning mode is a mode in which at least three of the GPS satellites 100 are captured followed by satellite signal reception and positioning computation is performed based on the received satellite signals to acquire positional information. In the positioning mode, the time information can be typically acquired from a satellite signal at the same time. In the positioning mode, however, it is not necessary to acquire the time information from a satellite signal.

The setting of the reception mode made by operation of the button 16 is stored in a reception mode storage section 660 in a storage device 60, which will be described later. When the reception mode is set to the timing mode, the second hand 121 moves to a "Time" position (5-second position), whereas when the reception mode is set to the positioning mode, the secondhand 121 moves to a "Fix" position (10-second position). The user can therefore readily check a set reception mode.

The reception mode is not necessarily indicated by the second hand 121 and may be displayed by a mode indication hand (mode hand) that is separately provided.

In a fixed-time reception process, which will be described later, the reception mode may be fixed to the timing mode or the positioning mode irrespective of the mode set with the button 16, or the reception mode may be set with the button 16 also in the fixed-time reception process. In the present embodiment, the reception mode is fixed to the timing mode in the fixed-time reception process.

When the button 15 is pressed for a short period (shorter than 3 seconds, for example), a result display process in which a result of a preceding reception process is displayed is carried out. That is, when the reception was successful in the positioning mode, the second hand 121 moves to the "Fix" position (10-second position), whereas when the reception was successful in the timing mode, the second hand 121 moves to the "Time" position (5-second position). When the reception was unsuccessful, the second hand 121 moves to an "N" position (20-second position).

Structure of Electronic Timepiece

The electronic timepiece 1 includes an exterior case 17 made of a metal, such as stainless steel (SUS) or titanium, as shown in FIG. 2. The exterior case 17 has a substantially cylindrical shape. A front glass plate 19, which covers a front-side opening of the exterior enclosure 17, is attached to the opening via a bezel 18. The bezel 18 is made of a nonmetal material, such as a ceramic material, to improve satellite signal reception performance. A case back 20 is attached to a rear-side opening of the exterior case 17. In the exterior case 17 are disposed the dial 11, a movement 21, a solar panel 22, a GPS antenna 23, a secondary battery 24, and other components.

The movement 21 includes a drive mechanism 210, which drives the indication hands 12. The drive mechanism 210 includes a stepper motor, a wheel train 211, a drive circuit that drives the stepper motor, and other components. The stepper motor is formed of a motor coil 212, a stator, a rotor, and other components and drives the indication hands 12 via the wheel train 211 and the rotary shaft 13.

A circuit substrate 25 is disposed in the movement 21 on the side thereof facing the case back 20.

To the circuit substrate 25 is attached a reception device 30, which processes a satellite signal received through the GPS antenna 23, a control device 40, which performs a variety of types of control, such as drive control of the reception device 30 and the stepper motor described above, a charge circuit 80, which charges electric power generated by the solar panel 22 into the secondary battery 24, and other components. The reception device 30 and the control device 40 are driven by the electric power supplied from the secondary battery 24.

Solar Panel

The solar panel 22 is a photo-electric power generator that photo-electrically generates electric power by converting optical energy into electric energy. The solar panel 22 includes 7 or 8 solar cells, although not shown, which are serially connected to each other and output electric power.

The solar panel 22 is supported by a solar panel support substrate 220, as shown in FIG. 2. The solar panel support substrate 220 is a conductive substrate made of a metal material, such as BS (brass), SUS (stainless steel), or a titanium alloy, and having a thickness of, for example, 0.1 mm. The thus formed solar panel support substrate 220 has the same current distribution as that in the GPS antenna 23, which is disposed in a position in the vicinity of the solar panel support substrate 220, and hence functions as part of the GPS antenna 23.

The solar panel support substrate 220 is so incorporated in the exterior enclosure 17 that they are not in contact with each other. That is, the solar panel support substrate 220 is so disposed that the outer circumferential edge thereof is set apart from and hence is not in contact with the inner circumferential surface of the exterior case 17.

The dial 11 and the solar panel 22 are so formed that the outer circumferential diameters thereof accord with the inner circumferential diameter of a dial ring 140. Since the dial ring 140 hides the outer circumferences of the dial 11 and the solar panel 22, the solar panel support substrate 220 is not visible from outside. Further, the outer shape of the solar panel support substrate 220 has a dimension greater than those of the solar panel 22 and the dial 11 and extends to the lower surface of the GPS antenna 23.

GPS Antenna

The GPS antenna 23 is a ring antenna including a ring-shaped dielectric base 231, which has a rectangular cross-sectional shape, and an antenna electrode 232 formed on the surface of the dielectric base 231.

The dielectric base 231 shortens the wavelength of an electric wave and can be made, for example, of a ceramic material primarily containing alumina ($\in r=8.5$), a ceramic material containing mica or what is called micarex ($\in r=6.5$ to 9.5), glass ($\in r=5.4$ to 9.9), or diamond ($\in r=5.68$).

The antenna electrode 232 is linearly formed integrally with the dielectric base 231 by printing a metal device made of copper, silver, or any other conductive material on the surface of the dielectric base 231 or attaching a metal plate made of copper, silver, or any other conductive material to the surface of the dielectric base 231. The antenna electrode 232 may instead be formed by patterning an electroless plating material on the surface of the dielectric base 231.

A connection pin 31 is in contact with the antenna electrode 232. The connection pin 31 is inserted into a substantially cylindrical connection base 32. The connection base 32 is connected to printed wiring on the circuit substrate 25 and extends upward therefrom.

The connection pin 31 and the connection base 32 are electrically connected to the reception device 30 via the printed wiring. The tubular connection base 32 has an urging member, such as a coil spring, provided therein, and the urging member urges the connection pin 31 inserted into the connection base 32 toward the antenna electrode 232. The connection pin 31 is therefore pressed against a feed point of the antenna electrode 232, whereby the connection between the connection pin 31 and the antenna electrode 232 is maintained, for example, even when an impact acts on the electronic timepiece 1.

In the present embodiment, the case back 20, which is formed of a conductive member, also serves as a ground plate (reflection plate) for the GPS antenna 23. The case back 20 is electrically continuous with a ground terminal 26, which is provided in the movement 21. The ground terminal 26 is connected to a ground potential of the reception device 30 in the movement 21. The case back 20 is therefore electrically connected to the ground potential of the reception device 30 via the ground terminal 26 and functions as a ground plate (reflection plate) that reflects an electric wave incident through the front glass plate 19 toward the GPS antenna 23. Since the exterior case 17, which is formed of a conductive member and in contact with the case back 20, also has the ground potential, the exterior case 17 also functions as the ground plate.

Further, the case back 20 and the exterior case 17, each of which is made of a metal, not only function as the ground plate but also prevent the GPS antenna 23 from being affected by a user's arm around which the electronic timepiece 1 is worn. That is, when the case is a plastic case, the GPS antenna 23 is so affected by the arm located close thereto that the resonance frequency of the GPS antenna 23 in a case where the electronic timepiece 1 is worn differs from that in a case where the electronic timepiece 1 is not worn. Such a difference is not preferable because the performance of the GPS antenna 23 varies. In contrast, since the case is made of a metal, a shield effect resulting therefrom can prevent the GPS antenna 23 from being affected by the arm. There is therefore hardly a difference in antenna characteristics between the case where the electronic timepiece 1 is worn and the case where the electronic timepiece 1 is not worn and stable reception performance is achieved in the present embodiment. It is, however, noted that a plastic case can instead be employed.

Secondary Battery

The secondary battery 24 is a power supply device in the electronic timepiece 1 and accumulates the electric power generated by the solar panel 22.

In the electronic timepiece 1, two electrodes of the solar panel 22 and two electrodes of the secondary battery 24 can be electrically connected to each other via two conductive coil springs 22A. When the electrodes are connected to each other, the photo-electric power generation of the solar panel 22 charges the secondary battery 24. In the present embodiment, the secondary battery 24 is a lithium ion secondary battery, which is suitable for a mobile apparatus, but may instead be a lithium polymer battery or any other type of secondary battery or an electricity storage different from a secondary battery (such as capacitive device).

Circuit Configuration of Electronic Timepiece

Figure 3:
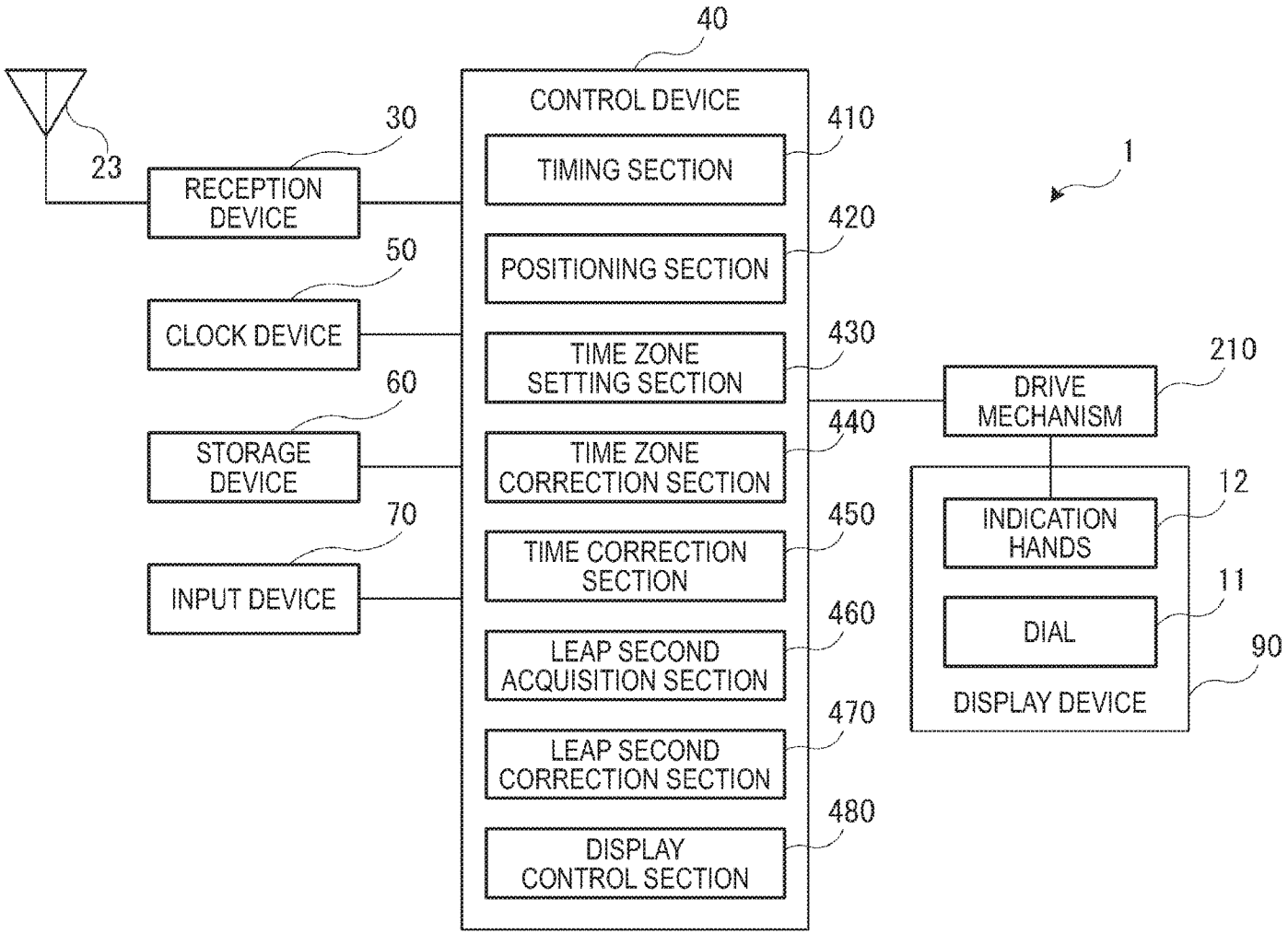
FIG. 3 is a block diagram showing the configuration of the electronic timepiece.

FIG. 3 is a block diagram showing the configuration of the electronic timepiece 1. The electronic timepiece 1 includes the reception device 30 (reception section), the control device 40, a clock device 50 (clock section), the storage device 60, the input device 70 (operation section), and a display device 90 (display section).

Reception Device

The reception device 30 is a load driven by the electric power accumulated in the secondary battery 24. When driven by the control device 40, the reception device 30 receives a satellite signal transmitted from any of the GPS satellites 100 via the GPS antenna 23. Having successfully received the satellite signal, the reception device 30 transmits acquired orbital information, GPS time information, and other types of information to the control device 40. On the other hand, having unsuccessfully received the satellite signal, the reception device 30 transmits information on the unsuccessful reception to the control device 40. The configuration of the reception device 30 is the same as the configuration of a known GPS reception circuit and will therefore not described.

Navigation Message

Figure 4A:
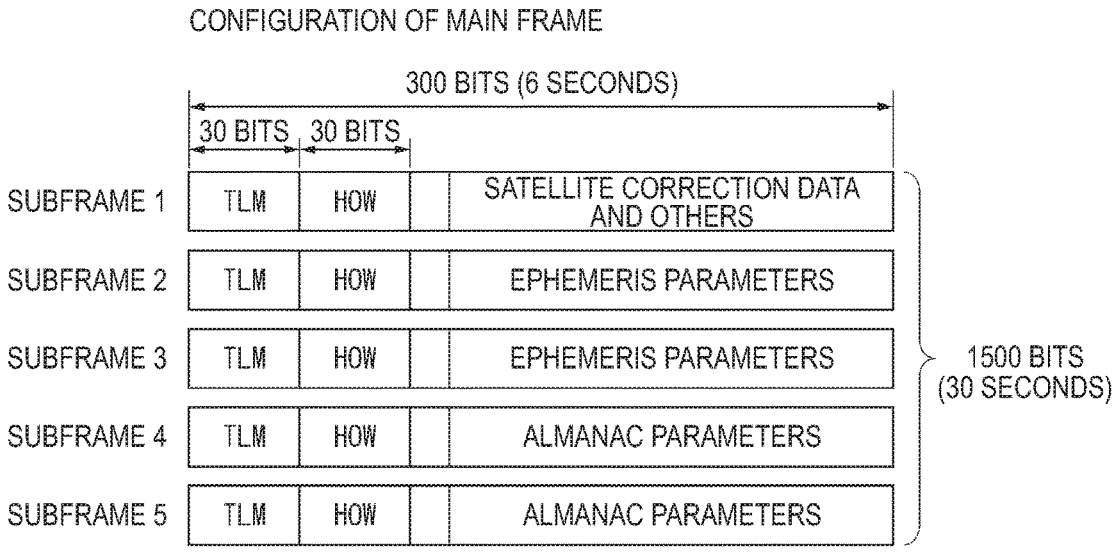
FIGS. 4A to 4C describe the configuration of a navigation message.
Figure 4B:
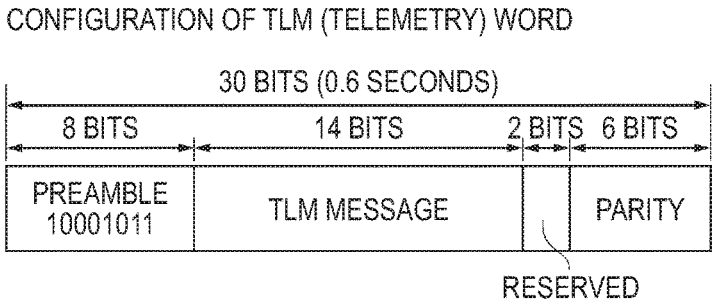
Figure 4C:
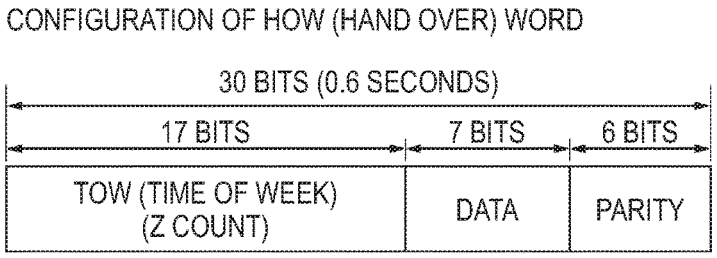

FIGS. 4A to 4C describe the configuration of a navigation message contained in a satellite signal received by the reception device 30.

The navigation message is configured as data formed of data units each having a main frame formed of a total number of 1500 bits, as shown in FIG. 4A. The main frame is divided into five 300-bit subframes 1 to 5. Data in a single subframe is transmitted from each of the GPS satellites 100 in 6 seconds. Data in a single main frame is therefore transmitted from each of the GPS satellites 100 in 30 seconds.

Figure 5:
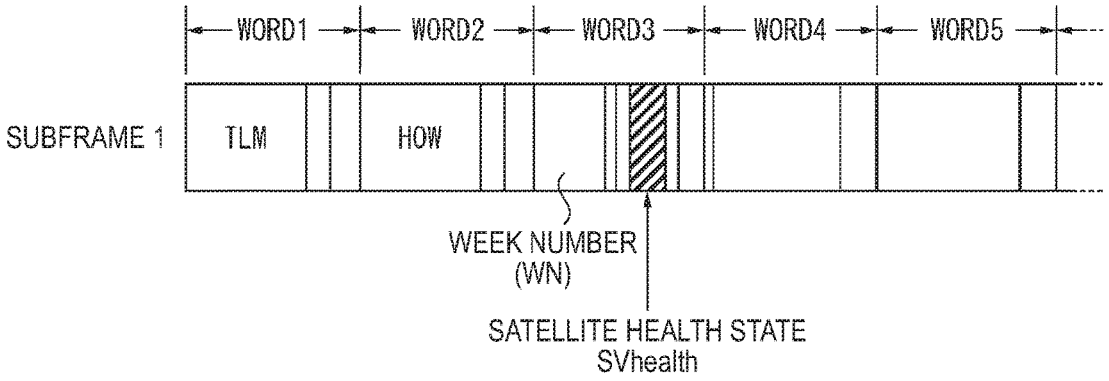
FIG. 5 describes the configuration of a subframe.

The subframe 1 contains satellite correction data including week number data (WN) and a satellite health state (SVhealth), as shown in FIG. 5 as well as FIG. 4A. The week number data is information representing a week containing current GPS time information. The origin of GPS time information is 00:00:00, Jan. 6, 1980 in UTC (coordinated universal time), and the week starts on this date has a week number of 0. The week number data is updated on a week basis.

The satellite health state (SVhealth) is a code representing whether or not the satellite is defective. Checking the code prevents a signal from a defective satellite from being used. Specifically, a satellite health state of "0" indicates that the navigation message is normal, whereas a satellite health state of "1" indicates that part or entire of the navigation message is abnormal.

Among the five subframes, the subframes 1 to 3 contain information specific to each of the satellites, and the same information is therefore repeatedly transmitted each time. Specifically, each of the subframes 1 to 3 contains clock correction information and orbital information (ephemeris) associated with the satellite itself that is transmitting the subframe. In contrast, each of the subframes 4 and 5 contains orbital information (almanac) and ionosphere correction information associated with all the satellites, and the information described above is formed of a large amount of data and hence divided into pages before incorporated in the subframe.

That is, the data transmitted by using each of the subframes 4 and 5 is divided into pages 1 to 25, and the information in the different pages is sequentially transmitted on a frame basis. Since transmitting information in the entire pages requires 25 frames, receiving the entire information in a navigation message requires 12 minutes and 30 seconds.

Further, each of the subframes 1 to 5 starts with a TLM (telemetry) word, which stores 30-bit TLM (telemetry word) data, and further contains a HOW word, which stores 30-bit HOW (hand over word) data.

Therefore, the TLM word and the HOW word are transmitted from each of the GPS satellites 100 at the intervals of 6 seconds, whereas the satellite correction data, such as the week number data, the ephemeris parameters, and the almanac parameters are transmitted at the intervals of 30 seconds.

The TLM word contains preamble data, a TLM message, a reserved bit, and parity data, as shown in FIG. 4B.

The HOW word contains GPS time information called TOW (time of week, also called "Z count"), as shown in FIG. 4C. The Z count data is so designed that elapsed time from zero hour on every Sunday is displayed in seconds, and that the elapsed time is reset to zero at zero hour on the following Sunday. That is, the Z count data is information on a week basis expressed in seconds counted from the start of a week. The Z count data is GPS time information on the time when a starting bit of the following subframe data is transmitted. For example, the Z count data in the subframe 1 is GPS time information on the time when a starting bit of the subframe 2 is transmitted. The HOW data further contains 3-bit data representing the ID of the subframe (ID code).

Leap second information is stored in the page 18 in the subframe 4. That is, the page 18 in the subframe 4 in a satellite signal stores "current leap second $\Delta t_{LS}$," "leap second update week $WN_{LSF}$," "leap second update day DN," and "leap second after the update $\Delta t_{LSF}$," which are data on the leap second.

The "leap second update week, the leap second update day, and the leap second after the update" are pieces of information necessary for the following leap second update process. When it is determined to perform leap second update, these pieces of information are updated to new data on a day about 6 months before the update day. These pieces of information remain intact after leap second update is performed. Therefore, until it is determined to perform the following leap second update, the "current leap second $\Delta t_{LS}$" and the "leap second after the update $\Delta t_{LSF}$" are equal to each other. It can therefore be determined that no update is scheduled when $\Delta t_{LS}$ and $\Delta t_{LSF}$ are equal to each other, and that the update is scheduled when they differ from each other.

Further, the time information (Z count), which is stored in each of the subframes, can be received at the intervals of 6 seconds.

Therefore, in a state in which no calendar has been set, for example, after system reset, it is necessary to receive the subframe 1, which is transmitted every 30 seconds, and acquire the week number and the satellite health state to grasp information on year/month/day. Further, to calculate UTC from GPS time calculated from the week number and the Z count, it is necessary to receive the page 18 in the subframe 4 transmitted every 12.5 minutes to grasp information on the "current leap second."

On the other hand, after the acquisition of the week number and the current leap second, elapsed time can be counted from the time of the week number acquisition, whereby the current week number associated with the GPS satellite 100 can be found based on the acquired week number and the elapsed time without re-acquisition of the week number. Therefore, acquiring only the Z count allows acquisition of the current GPS time, and correction by using the current leap second information allows determination of UTC.

Clock Device

The clock device 50 includes a quartz oscillator or any other component driven by the electric power accumulated in the secondary battery 24 and updates time data by using a reference signal based on an oscillation signal from the quartz oscillator.

Display Device

The display device 90 is formed of the indication hands 12 and the dial 11 and displays time.

Storage Device

Figure 6:
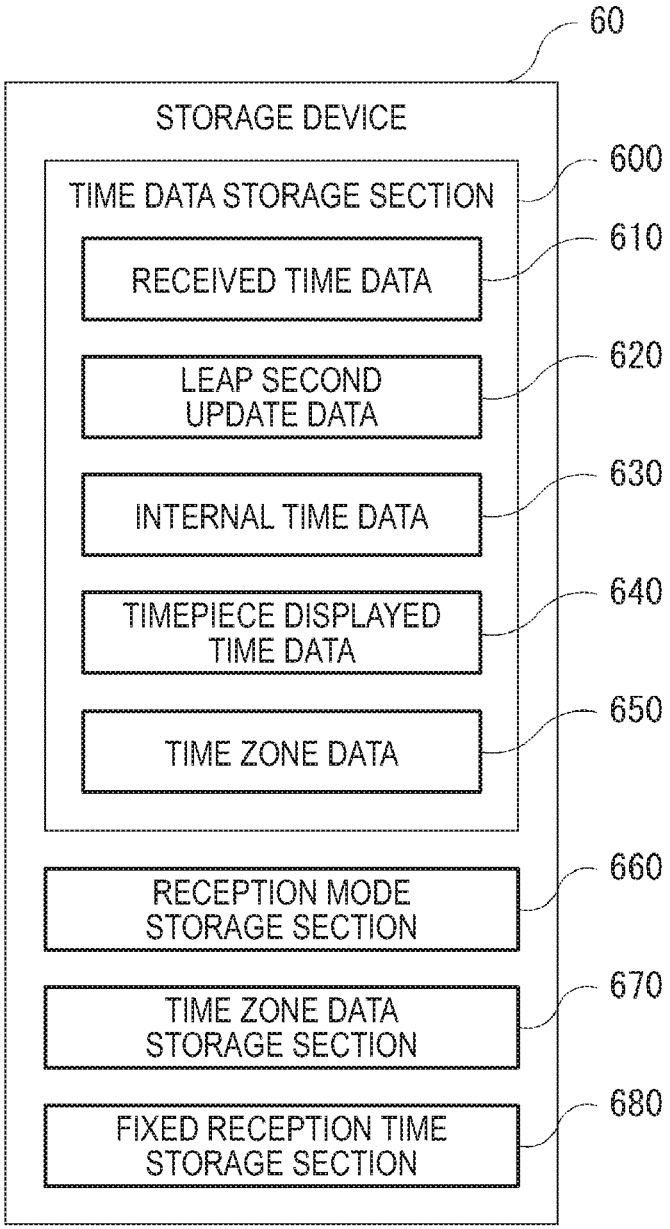
FIG. 6 is a block diagram showing the configuration of a storage device.

The storage device 60 includes a time data storage section 600, a reception mode storage section 660, a time zone data storage section 670, and a fixed reception time storage section 680, as shown in FIG. 6.

The time data storage section 600 stores received time data 610, leap second update data 620, internal time data 630, timepiece displayed time data 640, and time zone data 650.

The received time data 610 stores time information acquired from a satellite signal (GPS time information). The received time data 610 is typically updated by the clock device 50 every 1 second, and when a satellite signal is received, the time information stored in the received time data 610 is corrected by using the acquired time information (GPS time information).

The leap second update data 620 stores at least data on the current leap second. When data on "the leap second update week, the leap second update day, and the leap second after the update" are acquired, these data are also stored in the leap second update data 620.

The internal time data 630 stores internal time information. The internal time information is updated by using the GPS time information stored in the received time data 610 and the "current leap second" stored in the leap second update data 620. That is, the internal time data 630 stores UTC (coordinated universal time). When the received time data 610 is updated by the clock device 50 described above, the internal time information is also updated.

The timepiece displayed time data 640 stores time data formed of the internal time information in the internal time data 630 described above but corrected based on time zone data (time zone information, time difference information) in the time zone data 650. The time zone data 650 is set, for example, by using positional information obtained when satellite signals are received in the positioning mode.

The reception mode storage section 660 stores the reception mode set when the user operates the button 16, as described above.

The time zone data storage section 670 stores the positional information (latitude and longitude) and the time zone information related to each other. Therefore, when positional information is acquired in the positioning mode, the control device 40 acquires time zone data based on the positional information (latitude and longitude).

The time zone data storage section 670 may further store a city name and time zone data related to each other. In this case, when the user operates the input device 70 to select the name of a city where the user desires to know the local time, the control device 40 only needs to search the time zone data storage section 670 for the name of the city set by the user, acquire time zone data corresponding to the name of the city, and set the time zone data in the time zone data 650.

The fixed reception time storage section 680 stores fixed reception time at which a timing section 410 carries out a fixed-time reception process. The fixed reception time stored in the fixed reception time storage section 680 is the last time when the button 15 was operated with successful forced reception.

Control Device

The control device 40 is formed of a CPU that controls the electronic timepiece 1. The control device 40 includes a timing section 410, a positioning section 420, a time zone setting section 430, a time zone correction section 440, a time correction section 450, a leap second acquisition section 460, a leap second correction section 470, and a display control section 480.

Timing Section

The timing section 410 activates the reception device 30 to cause it to carry out the reception process in the timing mode. In the present embodiment, the reception process in the timing mode includes an automatic reception process and a manual reception process.

The automatic reception process includes two types of automatic reception process, a fixed-time automatic reception process and an optical automatic reception process. That is, when the timepiece displayed time data 640 that is being clocked reaches the fixed reception time stored in the fixed reception time storage section 680, the timing section 410 activates the reception device 30 to cause it to carry out the fixed-time automatic reception process in the timing mode.

On the other hand, when it is determined that the voltage or current of the electric power generated by the solar panel 22 reaches a preset value or becomes greater than the preset value, and that the solar panel 22 is irradiated with sunlight in an outdoor environment, the timing section 410 activates the reception device 30 to cause it to carry out the optical automatic reception process in the timing mode. The number of processes in which the reception device 30 is activated in accordance with the state of power generation of the solar panel 22 may be limited to, for example, once a day.

Further, when the user presses the button 15 on the input device 70 to perform the forced reception operation in the state in which the reception mode is set to the timing mode, the timing section 410 activates the reception device 30 to cause it to carryout the manual reception process in the timing mode.

The timing section 410 causes the reception device 30 to capture at least one of the GPS satellites 100 and receive a satellite signal transmitted from the captured GPS satellite 100 to acquire time information.

Positioning Section

When the user presses the button 15 on the input device 70 to perform the forced reception operation in the state in which the reception mode is set to the positioning mode, the positioning section 420 activates the reception device 30 to cause it to carry out the reception process in the positioning mode.

The control device 40 may switch the reception process in the timing mode carried out by the timing section 410 to the reception process in the positioning mode carried out by the positioning section 420 or vice versa in accordance with the period for which the user keeps pressing the button 15 irrespective of the reception mode stored in the reception mode storage section 660. For example, the control device 40 may carry out the reception process in the timing mode when the button 15 is pressed for a first set period (longer than or equal to 3 seconds but shorter than 6 seconds) and may carry out the reception process in the positioning mode when the button 15 is pressed for a second set period (longer than or equal to 6 seconds).

Having started the reception process in the positioning mode, the positioning section 420 causes the reception device 30 to capture at least three, preferably four or more of the GPS satellites 100, and receive satellite signals transmitted from the captured GPS satellites 100, and calculates and acquires positional information. The positioning section 420 can further acquire time information at the same time when the satellite signals are received.

Time Zone Setting Section

When the positioning section 420 has successfully acquired positional information, the time zone setting section 430 sets time zone data based on the acquired positional information (latitude and longitude). Specifically, the time zone setting section 430 selects and acquires time zone data (time zone information, that is, time difference information) corresponding to the positional information from the time zone data storage section 670 and stores the acquired time zone data in the time zone data 650.

The Japan standard time (JST) is 9 hours ahead of UTC (UTC+9). For example, when the positional information acquired by the positioning section 420 indicates Japan, the time zone setting section 430 reads time difference information associated with the Japan standard time (+9 hours) from the time zone data storage section 670 and stores the read time difference information in the time zone data 650.

Time Zone Correction Section

After the time zone setting section 430 sets time zone information, the time zone correction section 440 uses the time zone data described above to correct the timepiece displayed time data 640 described above. The timepiece displayed time data 640 is therefore corrected to time produced by adding the time zone data to the internal time data 630, which is UTC.

Time Correction Section

When time information has been successfully acquired in the reception process carried out by the timing section 410 or the positioning section 420, the time correction section 450 corrects the received time data 610 by using the acquired time information. The internal time data 630 and the timepiece displayed time data 640 are therefore also corrected.

Leap Second Acquisition Section

In a case where a leap second reception condition is satisfied and the timing section 410 or the positioning section 420 carries out the reception process, the leap second acquisition section 460 activates the reception device 30 to cause it to acquire leap second information subsequently to the acquisition of time information performed by the timing section 410 or the positioning section 420.

The case where a leap second reception condition is satisfied is either a case where the leap second update data 620 stores no leap second information or a case where the month/day derived from the internal time information stored in the internal time data 630 falls within a leap second reception period and no leap second information reception has been successful within the period.

In the present embodiment, the leap second reception period is set semiannually. That is, at present, the leap second is updated semiannually at shortest, and in recent years, it has been updated approximately once a year or once a few years. First specific priority days on which the leap second is updated are the last days of December and June. Further, the leap second information also contains information on the following leap second update day and the leap second after the update.

Therefore, semiannual reception of the leap second information (specifically, in June and December) allows determination whether or not the following semiannual leap second update is scheduled.

Therefore, when the month/day in the internal time information stored in the internal time data 630 falls within the period from June 1 to 30 or December 1 to 31, and no leap second information reception has been successful in the period, the leap second acquisition section 460 determines that the leap second reception condition is satisfied and acquires the leap second information.

Since the leap second reception period only needs to be a half year before a leap second update day, the leap second reception period is not necessarily set in June or December and may be set semiannually in an arbitrary manner, such as in July and January or August and February.

The leap second acquisition section 460 then causes the reception device 30 to capture at least one of the GPS satellites 100 and receive a satellite signal transmitted from the captured GPS satellite 100 and acquires leap second information. It is noted as described above that the leap second information is stored in the page 18 in the subframe 4 and transmitted at the intervals of 12.5 minutes.

The navigation message is managed on a week basis, and leap second information transmission timing is also preset. The leap second acquisition section 460 therefore receives leap second information at the leap second information transmission timing based on the internal time data 630 clocked by the clock device 50.

When activating the reception device 30 to cause it to receive a satellite signal, the leap second acquisition section 460 may also check the subframes and pages in the satellite signal and find the next leap second information transmission timing. In this case, when the period until leap second information is transmitted next time is short (shorter than 60 seconds, for example), the leap second acquisition section 460 continues the reception to acquire the leap second information. When the period until leap second information is transmitted next time is long (longer than or equal to 60 seconds, for example), the leap second acquisition section 460 temporarily terminates the reception process and resumes the reception in accordance with the leap second information transmission timing.

Leap Second Correction Section

The leap second correction section 470 uses the leap second information acquired by the leap second acquisition section 460 to correct the leap second information stored in the leap second update data 620.

Display Control Section

The display control section 480 causes the display device 90 to display the time indicated by the timepiece displayed time data 640. That is, the display control section 480 causes the display device 90 to display the time by controlling the drive mechanism 210 to move the indication hands 12.

Further, when the leap second acquisition section 460 is on standby to receive leap second information, the display control section 480 causes the display device 90 to display leap second standby information representing that the timepiece is on standby to receive leap second information. That is, the display control section 480 causes the display device 90 to display the remaining period before leap second information reception start time in a one-minute decrement format by controlling the drive mechanism 210 to move the second hand 121.

Further, when the input device 70 is so operated that it receives a reception result display instruction, the display control section 480 causes the display device 90 to display no leap second information reception result but display a result of time information reception performed by the timing section 410 by controlling the drive mechanism 210 to move the second hand 121. That is, in the case of successful reception, the second hand 121 is moved to the "Time" position (5-second position), whereas in the case of unsuccessful reception, the second hand 121 is moved to the "N" position (20-second position).

That is, in the timing mode, when the time information reception is followed by the leap second information reception, successful time information reception is considered as successful reception even when the leap second information reception is unsuccessful, and the display control section 480 moves the second hand 121 to the "Time" position (5-second position).

Operation of Control Device

Figure 7:
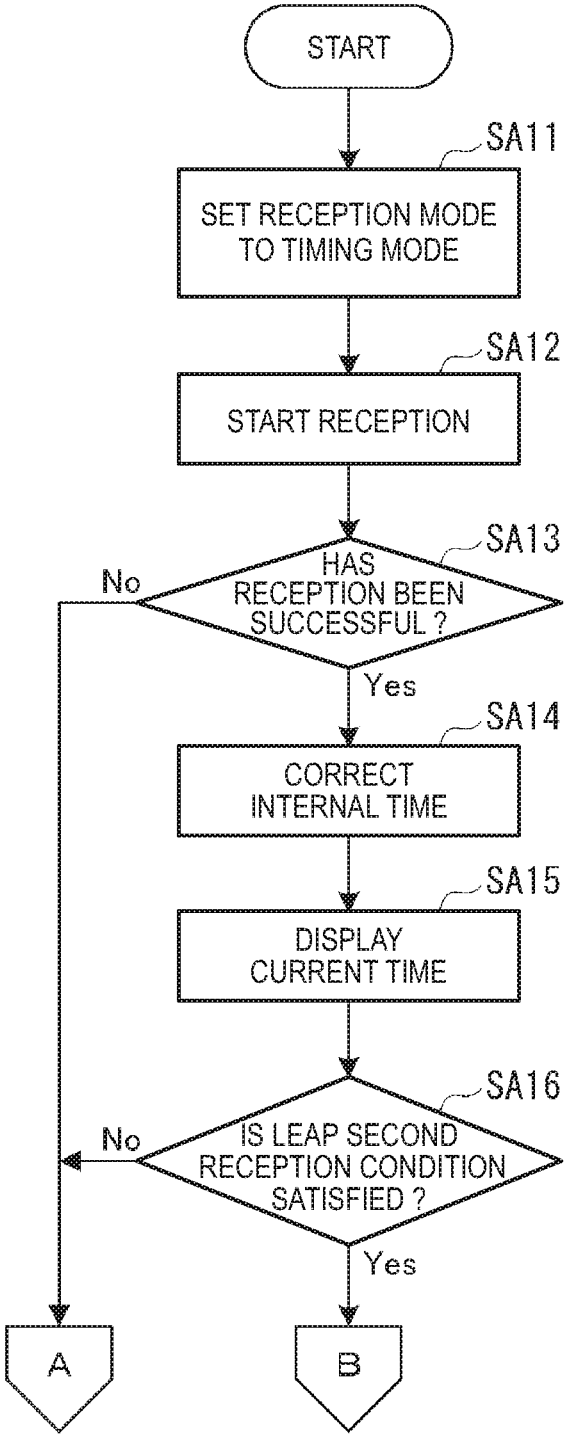
FIG. 7 is a flowchart showing a reception process in a timing mode in a first embodiment.
Figure 8:
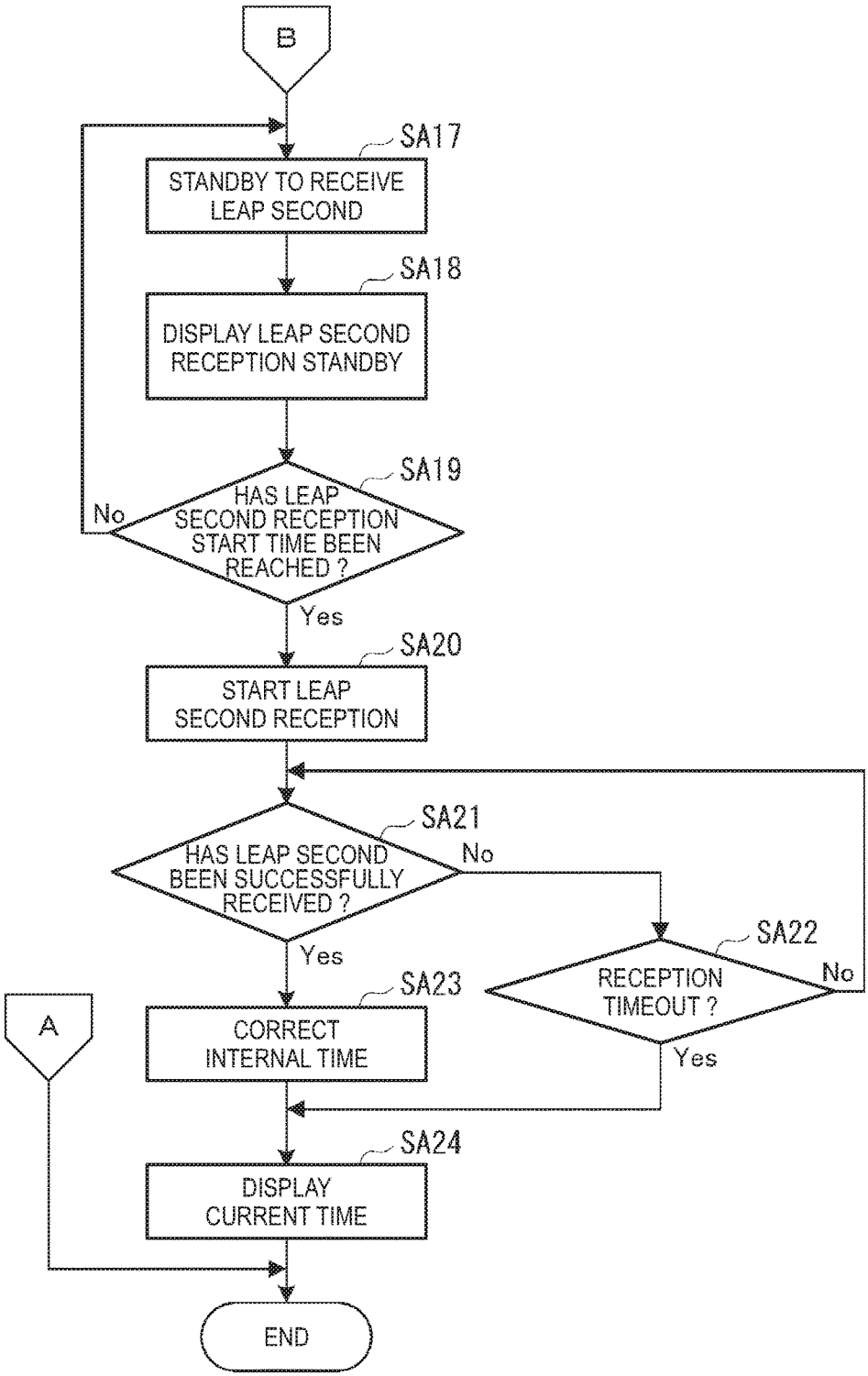
FIG. 8 is another flowchart showing the reception process in the timing mode in the first embodiment.

FIGS. 7 and 8 are flowcharts showing the reception process in the timing mode of the electronic timepiece 1 in the first embodiment.

When the automatic reception start condition is satisfied, or when the button 15 is pressed for the first set period (longer than or equal to 3 seconds but shorter than 6 seconds, for example), the timing section 410 sets the reception mode to the timing mode (SA11) and starts the reception process (SA12). The timing section 410 determines that the automatic reception start condition is satisfied when the fixed reception time has been reached or when the voltage or current of the electric power generated by the solar panel 22 has reached a preset value or become greater than the preset value, as described above.

That is, the timing section 410 activates the reception device 30 to cause it to search for the GPS satellites 100 to be captured and capture at least one of the GPS satellites 100. Having captured any of the GPS satellites 100, the timing section 410 causes the reception device 30 to start receiving a satellite signal and acquires time information.

The timing section 410 then evaluates whether the reception was successful (SA13). That is, when time information is acquired, and the acquired time information is evaluated to be correct based, for example, on comparison with the internal time, the timing section 410 evaluates that the reception was successful.

When the evaluation result in SA13 is No, the timing section 410 terminates the reception process.

When the evaluation result in SA13 is Yes, the time correction section 450 corrects the internal time (SA14). That is, the time correction section 450 corrects the received time data 610 and the internal time data 630 by using the time information acquired by the timing section 410. At this point, when the leap second update data 620 stores the current leap second, the leap second correction section 470 corrects the internal time data 630 by using the stored current leap second. Once the internal time data 630 is corrected, the timepiece displayed time data 640 is also corrected by using the set time zone data 650.

The display control section 480 then causes the display device 90 to display the current time (SA15). That is, the display control section 480 causes the display device 90 to display the time indicated by the timepiece displayed time data 640. Specifically, the display control section 480 controls the drive mechanism 210 to move the indication hands 12 (second hand 121, minute hand 122, and hour hand 123) for the time display.

Figure 9A:
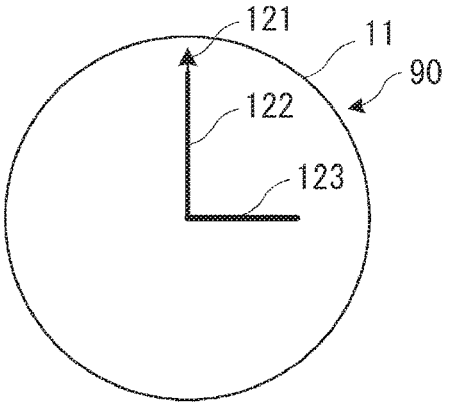
FIGS. 9A to 9D show examples of time displayed by a display device.
Figure 9B:
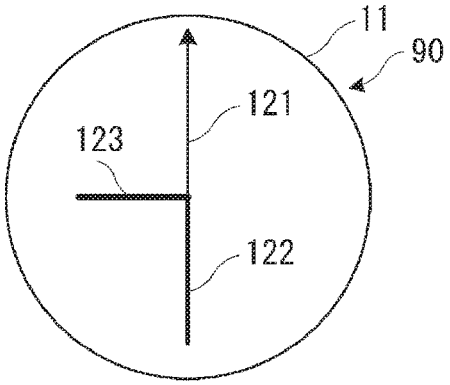

For example, when the displayed time before the display device 90 displays the current time is 3:00:00 (hour/minute/second) as shown in FIG. 9A, and the timepiece displayed time data 640 is corrected to 9:30:00 (hour/minute/second) in SA14, the display control section 480 causes the display device 90 to display 9:30:00 (hour/minute/second) by moving the indication hands 12, as shown in FIG. 9B.

As a result, the display device 90 displays the time corrected based on the received time information.

The control device 40 then evaluates whether the leap second reception condition is satisfied (SA16). That is, the evaluation in SA16 made by the control device 40 is Yes when the leap second update data 620 stores no leap second information or when the month/day derived from the internal time information stored in the internal time data 630 falls within the leap second reception period (June 1 to 30 and December 1 to 31) and no leap second information has been successful within the period.

When the evaluation result in SA16 is No, the control device 40 terminates the reception process.

When the evaluation result in SA16 is Yes, the leap second acquisition section 460 is on standby until the leap second information reception timing is reached (SA17). The display control section 480 then causes the display device 90 to display the leap second standby information representing that the timepiece is on standby to receive leap second information (SA18).

As described above, the leap second information is transmitted at the intervals of 12.5 minutes. Therefore, when the reception start in SA12 is followed by the leap second information reception, it is necessary to continue the reception process for 12.5 minutes at longest. In this case, the long reception period increases power consumption.

The leap second acquisition section 460 can find the leap second information transmission timing (leap second information reception start time) based on the internal time data 630 clocked by the clock device 50. The leap second acquisition section 460 therefore evaluates whether the leap second information reception start time has been reached (SA19), and when the evaluation result is No, the leap second acquisition section 460 continues the leap second information reception standby state (SA17) and the display of the leap second standby information (SA18).

Figure 9C:
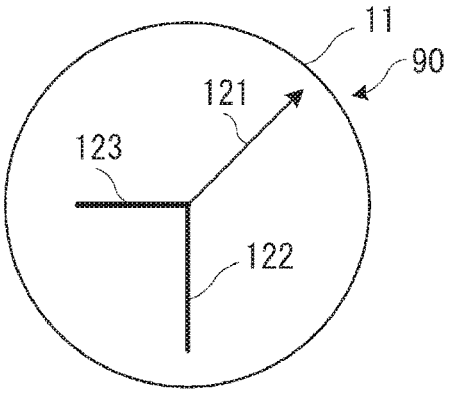

The leap second standby information is specifically displayed in SA18 as follows: That is, the display control section 480 causes the display device 90 to display the remaining period before the leap second information reception start time as the leap second standby information in the one-minute decrement format by controlling the drive mechanism 210 to move the second hand 121 as shown in FIG. 9C. At this point, the display control section 480 causes the display device 90 to keep displaying the current time by using the minute hand 122 and the hour hand 123.

When the evaluation result in SA19 is Yes, the leap second acquisition section 460 starts the leap second information reception process (SA20). The leap second acquisition section 460 activates the reception device 30 to cause it to search for the GPS satellites 100 to be captured and capture at least one of the GPS satellites 100. Having captured any of the GPS satellites 100, the leap second acquisition section 460 causes the reception device 30 to receive a satellite signal and acquires leap second information from the GPS satellite 100.

The leap second information reception start time described above is set also in consideration of a search period required to capture any of the GPS satellites 100.

The leap second acquisition section 460 then evaluates whether the leap second information has been successfully received from the GPS satellite 100 (SA21).

When the evaluation result in SA21 is No, the leap second acquisition section 460 evaluates whether reception timeout has occurred (SA22). In the present embodiment, when at least 60 seconds elapses from the leap second information reception start (SA20), it is evaluated that the reception timeout has occurred.

When the elapsed period from the leap second information reception start is shorter than 60 seconds and hence the evaluation result in SA22 is No, the leap second acquisition section 460 carries out the process in SA21 again and keeps receiving leap second information.

On the other hand, when the evaluation result in SA22 is Yes and hence it is evaluated that the reception timeout has occurred, the leap second acquisition section 460 carries out the process in SA24.

When the evaluation result in SA21 is Yes, the leap second correction section 470 stores the leap second information acquired by the leap second acquisition section 460 in the leap second update data 620 in the storage device 60.

The leap second correction section 470 then uses the current leap second in the leap second update data 620 to correct the internal time data 630 (SA23). Once the internal time data 630 is corrected, the timepiece displayed time data 640 is also corrected by using the set time zone data 650.

Figure 9D:
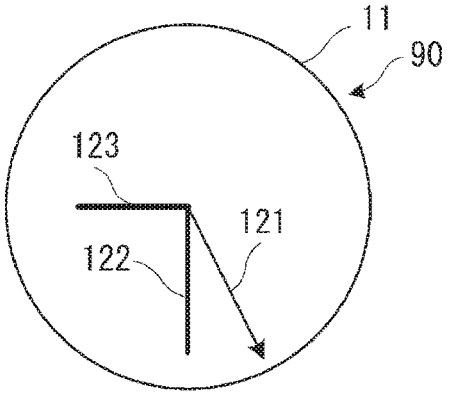

After the process in SA23 is carried out or when the evaluation result in SA22 is Yes, the display control section 480 causes the display device 90 to display the current time (SA24). That is, the display control section 480 causes the display device 90 to display time indicated by the timepiece displayed time data 640. Specifically, the display control section 480 controls the drive mechanism 210 to move the second hand 121, the minute hand 122, and the hour hand 123 as required for the time display, as shown in FIG. 9D.

As a result, after the process in SA23 is carried out, the display device 90 displays the time corrected based on the received time information and leap second information. When the evaluation result in SA22 is Yes, the display device displays time corrected based on the received time information and the stored leap second information.

Advantageous Effects Provided by First Embodiment

According to the present embodiment described above, the following advantageous effects are provided.

According to the electronic timepiece 1, when the leap second reception condition is satisfied, the display control section 480 causes the display device 90 to display, before the leap second acquisition section 460 acquires leap second information, the time indicated by the timepiece displayed time data 640 corrected by using received time information (SA15).

As a result, since the display device 90 displays the time corrected by using the received time information, the user can quickly check the corrected time without waiting for the leap second information reception timing.

When the leap second reception condition is satisfied, the display control section 480 causes the display device 90 to display the leap second standby information before the leap second acquisition section 460 acquires leap second information.

The user can therefore be informed that leap second information reception starts soon. For example, the user can move the electronic timepiece 1 to an environment where a satellite signal is received in a satisfactory manner or keep the electronic timepiece 1 stationary to improve a successful leap second information reception rate.

Having received the reception result display instruction, the display control section 480 causes the display device 90 to display no leap second information reception result but display a reception result showing whether or not the timing section 410 has succeeded in time information reception.

As a result, the user can determine by checking the reception result whether or not the time displayed by the display device 90 is a result of successful time information reception.

Although no leap second information reception result is displayed, the leap second information is typically updated once a few years. Therefore, successful acquisition of leap second information once during the period of a few years with unsuccessful leap second information reception at other attempts allows correct displayed time in many cases as long as time information is successfully received. However, displaying a result of unsuccessful leap second information reception as a reception result may mislead the user into believing that correct displayed time resulting from the successful time information reception is incorrect.

In contrast, according to the electronic timepiece 1, as long as the time information reception is successful, a reception result representing successful reception is displayed even when leap second information reception that follows the time information reception is unsuccessful. As a result, no displayed reception result representing unsuccessful reception will mislead the user into believing that correct displayed time is incorrect.

Since the reception result display instruction is outputted when the input device 70 is operated, the user can operate the input device 70 when the user desires to check a reception result to readily check the reception result.

The leap second standby information is the remaining period before the leap second information reception timing.

The user can therefore correctly find the leap second information reception timing and can move the electronic timepiece 1 without fail to an environment where a satellite signal can be received in a satisfactory manner at the leap second information reception timing.

When the leap second information reception condition is satisfied, the display control section 480 uses the minute hand 122 and the hour hand 123 to display the time indicated by corrected timepiece displayed time data 640 and uses the second hand 121 to display the leap second standby information.

Therefore, in an analog display timepiece having the second hand 121, the minute hand 122, and the hour hand 123, the display device 90 can display both the corrected time and the leap second standby information at the same time with no new display mechanism added to the display device 90.

As a result, the corrected time and the leap second standby information can be so displayed that they are readily visible to the user with the cost of the electronic timepiece 1 lowered.

Second Embodiment

A second embodiment of the invention will next be described with reference to the drawings.

The second embodiment differs from the first embodiment in that in the reception process in the timing mode, the display control section 480 causes the display device 90 to display a result of time information reception. The second embodiment is the same as the first embodiment in terms of the other configurations.

Figure 10:
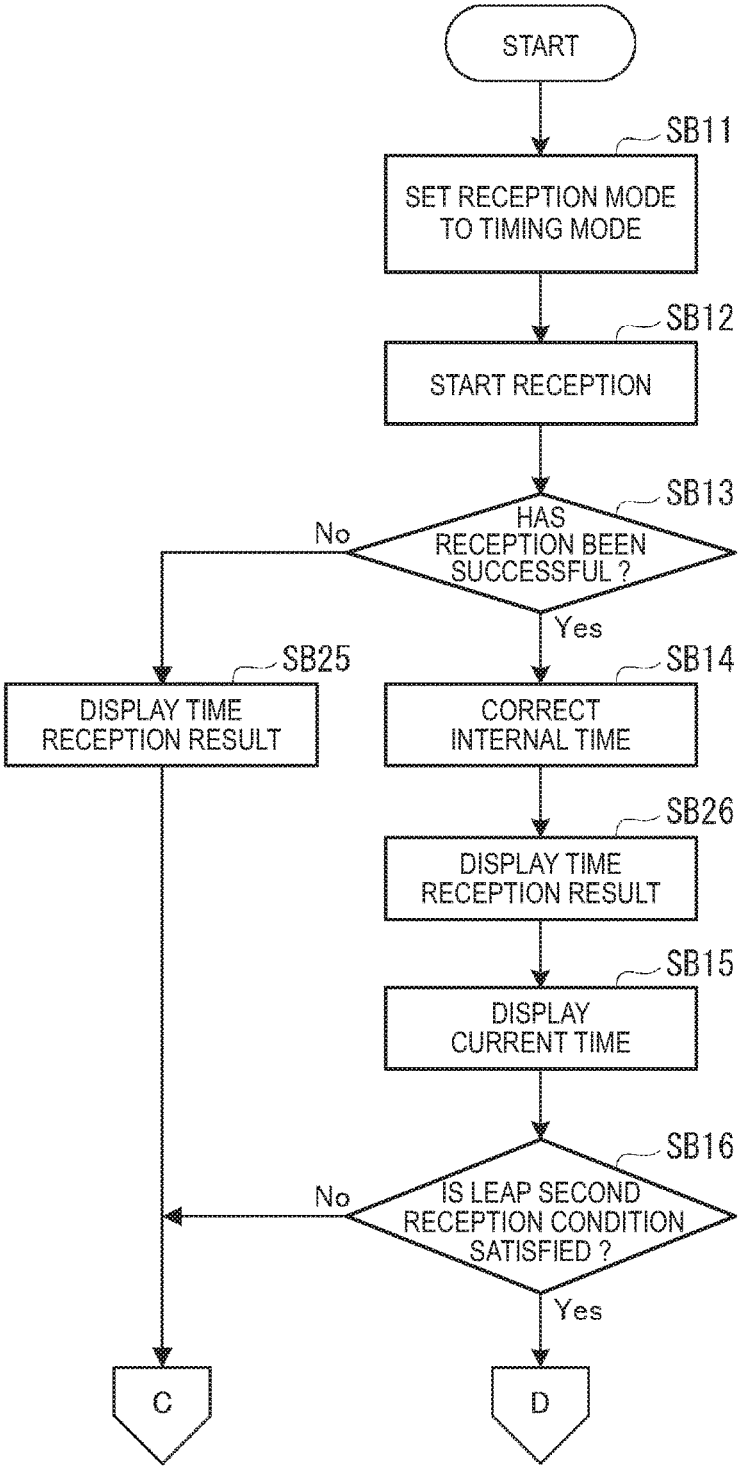
FIG. 10 is a flowchart showing the reception process in the timing mode in a second embodiment.
Figure 11:
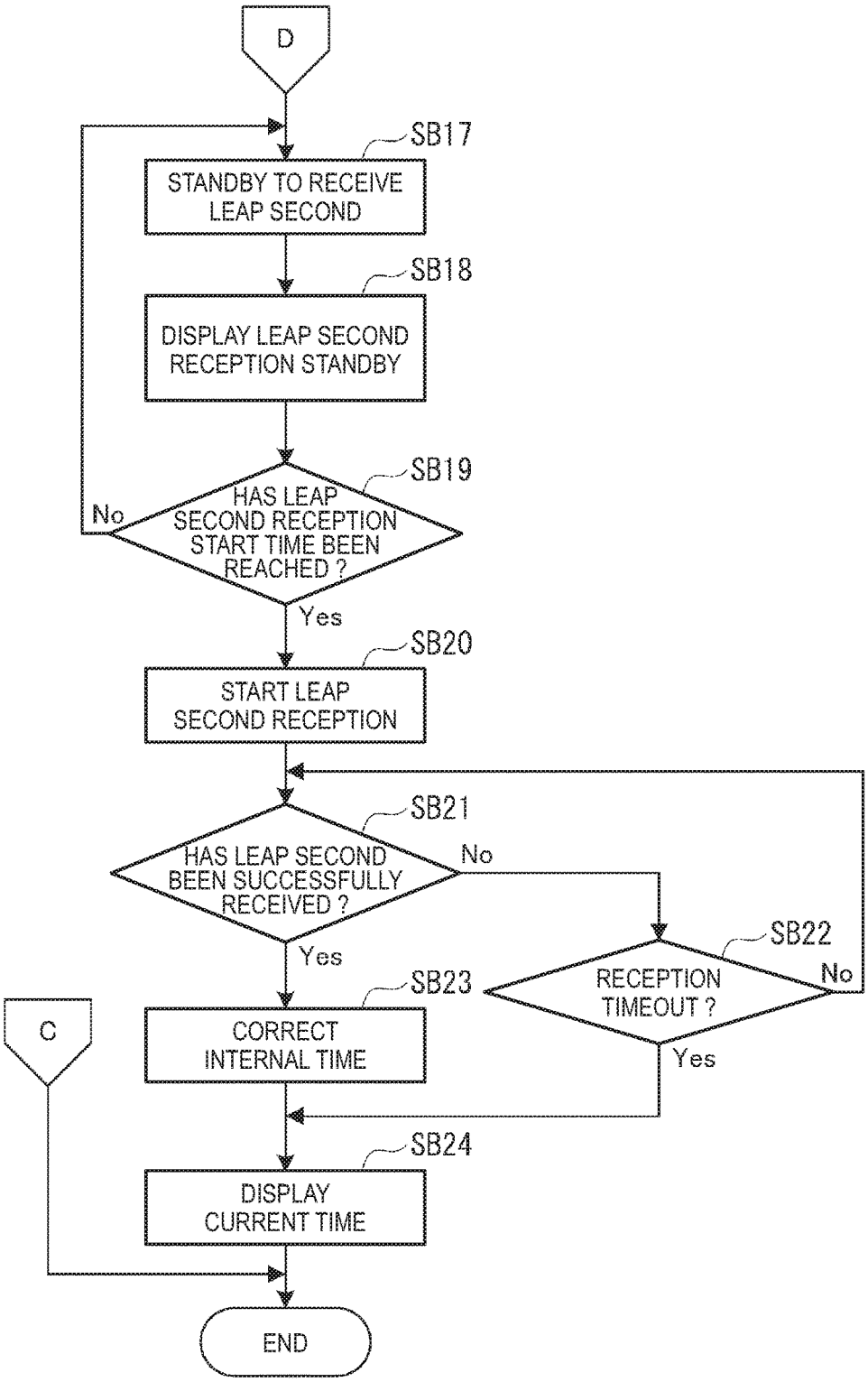
FIG. 11 is another flowchart showing the reception process in the timing mode in the second embodiment.

FIGS. 10 and 11 are flowcharts showing the reception process in the timing mode of the electronic timepiece in the second embodiment.

The control device 40 carries out processes in SB11 to SB26, as shown in FIGS. 10 and 11. The processes in SB11 to SB24 are the same as the processes in SA11 to SA24 in the first embodiment and will not therefore be described.

In the first embodiment, when the timing section 410 fails to receive time information (No in SA13), the reception process is terminated.

In contrast, in the second embodiment, when the timing section 410 fails to receive time information (No in SB13), the display control section 480 causes the display device 90 to display a reception result representing the unsuccessful time information reception (SB25).

Specifically, the display control section 480 controls the drive mechanism 210 to move the second hand 121 to the "N" position (20-second position).

The display control section 480 then terminates the reception process.

Further, in the first embodiment, after the time correction section 450 corrects the internal time (SA14), the display control section 480 causes the display device 90 to display the current time (SA15).

In contrast, in the second embodiment, after the time correction section 450 corrects the internal time (SB14), the display control section 480 causes the display device 90 to display a reception result representing the successful time information reception (SB26).

Specifically, the display control section 480 controls the drive mechanism 210 to move the second hand 121 to the "Time" position (5-second position).

The display control section 480 then causes the display device 90 to display the current time (SB15).

Advantageous Effect Provided by Second Embodiment

According to the second embodiment described above, the following advantageous effect is provided in addition to the advantageous effects provided by the same configurations and processes as those in the first embodiment described above.

When the leap second reception condition is satisfied, the display control section 480 causes the display device 90 to display, before the leap second acquisition section 460 acquires leap second information, a result of time information acquisition performed by the timing section 410 (SB26).

The user can therefore check the time information acquisition result, whereby the user can determine whether the received time information is reflected in the time displayed by the display device 90.

Other Embodiments

The invention is not limited to the configurations of the embodiments described above, and a variety of variations can be implemented within the scope of the substance of the invention.

For example, in the embodiments described above, the display device 90 may have a digital display section using, for example, a liquid crystal panel in addition to the dial 11 and the indication hands 12. In this case, the display control section 480 can use the indication hands 12 to display the current time in SA15 or SB15 and can use the digital display section to display the leap second standby information in SA18 or SB18.

The display device 90 may instead be formed only of the digital display section. In this case, the current time and the leap second standby information are displayed by using the digital display section.

In the second embodiment described above, the reception result is displayed in SB26 before leap second information is acquired, but the reception result may instead be displayed after leap second information is received (after it is evaluated to be Yes in SB21).

In the embodiments described above, the electronic timepiece 1 has the timing mode and the positioning mode. The electronic timepiece 1 may further have a leap second reception mode.

The leap second reception mode is a mode in which at least one of the GPS satellites 100 is captured followed by satellite signal reception and leap second information transmitted at predetermined intervals (intervals of 12.5 minutes in the case of GPS satellite signal) is acquired. In the leap second reception mode, the time information is also acquired from the satellite signal at the same time.

The user can set the leap second reception mode as well as the timing mode and the positioning mode by operating the button 16. When the reception mode is set to the leap second reception mode, the second hand 121 is moved to a "Leap (leap second)" position (55-second position).

When the reception process is carried out in the leap second reception mode, the timing section 410 acquires time information and the leap second acquisition section 460 subsequently acquires leap second information.

At this point, the display control section 480 causes the display device 90 to display the leap second standby information before the leap second acquisition section 460 acquires leap second information.

The user can therefore be notified that leap second information reception starts soon. For example, the user can move the electronic timepiece 1 to an environment where a satellite signal is received in a satisfactory manner to improve a successful leap second information reception rate.

The embodiments described above have been described with reference to the GPS satellites 100 as an example of the positional information satellite, but the positional information satellite in the invention is not limited to the GPS satellites 100 and may be a positional information satellite that transmits a satellite signal containing time information, such as a positional information satellite of any other global navigation satellite system (GNSS) including Galileo (EU), GLONASS (Russia) and BeiDou (China), a stationary satellite such as SBAS, and a quasi-zenith satellite.

The electronic timepiece according to any of the embodiments of the invention does not necessarily include the reception device 30, which receives satellite signals from the GPS satellites 100, and can also be used as an electronic timepiece including a device that consumes a large amount of electric power, such as an apparatus that wirelessly communicates with another electronic apparatus.

Further, the electronic timepiece is not limited to a wristwatch and can be used as a wide range of apparatus including a device that consumes a large amount of electric power and a timepiece mechanism used in a mobile situation, such as a mobile phone and a mobile GPS receiver used in mountain climbing.

The entire disclosure of Japanese Patent Application No. 2013-187151, filed Sep. 10, 2013 is expressly incorporated by reference herein.

What is claimed is:

1. An electronic timepiece comprising:

a display;

a receiver configured to receive a satellite signal containing time information and leap second information;

a clock section configured to clock internal time information; and a controller configured to correct the internal time information by using the received time information and the received leap second information, and to cause the display to display time based on the corrected internal time information;

wherein in a case where the receiver receives the leap second information after receiving the time information, the controller uses the received time information to correct the internal time information and causes the display to display time based on the corrected internal time information before the receiver receives the leap second information.

2. The electronic timepiece according to claim 1, wherein in a case where a leap second reception condition is satisfied, the receiver receives the leap second information after receiving the time information.

3. The electronic timepiece according to claim 2, wherein the leap second reception condition is that the electronic timepiece stores no leap second information.

4. The electronic timepiece according to claim 2, wherein the leap second reception condition is that a current time falls within a predefined leap second reception period and no previous leap second information reception operation has been successful within the predefined leap second reception period.

5. The electronic timepiece according to claim 1, wherein in the case where the receiver receives the leap second information after receiving the time information, the controller causes the display to further display, before the receiver receives the leap second information, leap second standby information indicating that the timepiece is on standby to receive the leap second information.

6. The electronic timepiece according to claim 5, wherein the leap second standby information is includes time period remaining before the receiver starts receiving the leap second information from the satellite signal.

7. The electronic timepiece according to claim 5, wherein:

the display section has a second hand, a minute hand, an hour hand, and a dial; and in the case where the receiver receives the leap second information after receiving the time information, the controller uses the minute hand and the hour hand to display time based on the corrected internal time information and uses the second hand to display the leap second standby information.

8. The electronic timepiece according to claim 1, wherein in the case where the receiver receives the leap second information after receiving the time information, the controller causes the display to further display, before the receiver receives the leap second information, a result of a performed time information reception operation that extracts time information from the satellite signal.

9. The electronic timepiece according to claim 1, wherein when the controller receives a reception result display instruction, the controller causes the display to display no leap second information reception result but to display a result of the time information reception.

10. The electronic timepiece according to claim 1, wherein in a case where an automatic reception start condition is satisfied, the controller controls the receiver to start a reception process that receives the satellite signal.

11. The electronic timepiece according to claim 10, wherein the automatic reception start condition is that the displayed time reaches a fixed reception time.

12. The electronic timepiece according to claim 10, further comprising:

a solar panel;

wherein the automatic reception start condition is that a power level of an electric power generated by the solar panel reaches a level not lower than a preset value.

13. An electronic apparatus comprising:

a display;

a receiver configured to receive a satellite signal containing time information and leap second information;

a clock section configured to clock internal time information;

a controller configured to instruct the receiver as to when to start receiving the satellite signal, and to correct the internal time information by using the received time information and the received leap second information;

wherein in a case where the receiver recovers the time information from the satellite signals before recovering the leap second information from the satellite signal, the controller corrects the internal time information by using the recovered time information and causes the display to display time based on the corrected internal time information before the receiver recovers the leap second information from the satellite signal.

* * * * *